US010093392B1

(12) United States Patent
Pincheon

(10) Patent No.: US 10,093,392 B1
(45) Date of Patent: Oct. 9, 2018

(54) DUAL WATERCRAFT SEPARABLE BOATING SYSTEM

(71) Applicant: Jeffrey R. Pincheon, Sebastian, FL (US)

(72) Inventor: Jeffrey R. Pincheon, Sebastian, FL (US)

( * ) Notice: Subject to any disclaimer, the term of this patent is extended or adjusted under 35 U.S.C. 154(b) by 0 days.

(21) Appl. No.: 15/896,221

(22) Filed: Feb. 14, 2018

(51) Int. Cl.
*B63B 3/08* (2006.01)
*B63B 7/04* (2006.01)
*B63B 3/34* (2006.01)

(52) U.S. Cl.
CPC ..... *B63B 3/08* (2013.01); *B63B 3/34* (2013.01); *B63B 7/04* (2013.01); *B63B 2003/085* (2013.01)

(58) Field of Classification Search
CPC ..... B63B 3/08; B63B 3/34; B63B 7/04
USPC ..... 114/352–354
See application file for complete search history.

(56) References Cited

U.S. PATENT DOCUMENTS 1,014,313 A * 1/1912 Macklind ..... B63B 21/56 114/249
8,851,798 B1 * 10/2014 Jaycox ..... F16C 11/04 114/353
2001/0029880 A1 * 10/2001 McCarthy ..... B60R 9/045 114/353

* cited by examiner

*Primary Examiner* — Stephen P Avila
(74) *Attorney, Agent, or Firm* — Patent CEO, LLC; Phillip Vales

(57) ABSTRACT

Two watercraft are connected together using a hinge system. A knuckle in one watercraft is placed in a corresponding space therefore in a second watercraft. Similarly, a buttress in the second watercraft is placed in a corresponding space in the first watercraft. An axle is placed within the buttresses as well as within the knuckle to attach the hinge device to attach the two watercraft together. This axle is also attached to a rear transom and to a forward bow connector. A second axle adds further rigidity to the system as it attached through a first watercraft passageway to both the transom and to the bow connector.

20 Claims, 7 Drawing Sheets

DUAL WATERCRAFT SEPARABLE BOATING SYSTEM

FIELD OF THE INVENTION

The present invention relates to a type of watercraft that is designed to be operable in different modes. More particularly, the present invention relates to a watercraft that from a first operational mode is able to be transformed into a second mode thereby facilitating multiple uses of the aforementioned.

BACKGROUND OF THE INVENTION

Hinges

Hinges are ubiquitous in the door industry and come in many sizes, shapes and have a variety of configurations. However, the most common type of hinge has two leaves that interact forming the main body of the hinge mechanism. In order for the hinge to function, however, each leaf has a group of knuckles disposed along an edge thereof so that a circular cavity within each knuckle is concentric with the other circular cavities of the particular leaf. When the two leaves are brought together such that the knuckle of the first leaf and the knuckles of the second leaf are now concentric, a pin having a cap or axle if you prefer is inserted within the concentrically positioned cavities locking them together. In this manner, a door can swivel upon hinges having these leaves mounted thereon and on an associated wall.

Various different types of small watercraft exist in the art from dinghies, watercrafts, sailboats, schooners, sloops, skiffs, yachts, gondolas and more. However, it often arises that as two or more people are onboard the particular watercraft, each desires to navigate to another portion of water to pursue varies interests such as sightseeing or fishing, diving, snorkeling. However, to move from one place to another is time consuming; another solution is to drop off the party wanting a different location or have them swim to where they want to be. Of course, it is not desirable to leave someone away from a main boat or ship because of drowning risk, shark/alligator attack and similar such problems.

Accordingly, there needs to be some solutions to overcome the aforementioned problems.

SUMMARY OF THE INVENTION

The present invention overcomes the deficiencies of the known art and the problems that remain unsolved by providing a Dual Watercraft Separable Boating system as follows.

A separable boat system comprising:

a first boat removably attached to a second boat;

wherein the first boat and the second boat are removably attached side by side through a separable hinge instead of front to back or back to front of a first boat to a second boat;

such that the separable hinge is held together using a first axle within a first shaft in a body of the first boat;

wherein the first boat and second boat have a unified first floatation operational mode when attached together such that the position of the second ship with respect to the first ship is immovable; and a dual boat second floatation operational mode when separated from each other.

In another aspect, further comprising:

a removable transom attached to the first and the second boat using the first axle within a first shaft in the body of the first boat.

In another aspect, further comprising:

a removable bow connector attached to the first and the second boat using the first axle within a first shaft in the body of the first boat.

In another aspect, the removable transom attached to the first and the second boat using a second axle within a second shaft in the body of the second boat.

In another aspect, further comprising:

a first wing extending from the first boat to the second boat.

In another aspect, further comprising:

a second wing extending from the second boat to the first boat.

In another aspect, wherein the first wing sits underneath the second wing.

In another aspect, the removable bow connector attached to the first and the second boat using a second axle within a second shaft in the body of the second boat.

In another aspect, wherein the first wing further comprises:

a knuckle.

In another aspect, further comprising:

a knuckle integral with a first integral wing of the first boat;

a buttress integral with a second integral wing of the second boat; wherein the separable hinge comprises a knuckle and buttress attached together through an axle.

In another aspect, wherein the second boat further comprises:

a buttress integral with and underneath a second wing integral with the second boat.

A separable boat comprising:

a first boat removably attached to a second boat having a first wing extending from the first boat to the second boat;

a second wing extending from the second boat to the first boat;

a knuckle integral with a first wing of the first boat;

a buttress integral with and underneath a second wing integral with the second boat; wherein the knuckle and the buttress are attached together using an axle therethrough that also attaches to a transom and to a bow connector.

A divisible boating system comprising:

a first watercraft connected through a separable hinge to a second watercraft;

a first wing integral with the first watercraft extending from the first watercraft to the second watercraft wherein the first wing has an integral knuckle;

a second wing integral with the second watercraft extending from the second watercraft to the first watercraft;

a buttress integral with the second watercraft; wherein the separable hinge is a knuckle and the buttress attached together using an axle therethrough.

In another aspect, a removable transom attached to the first watercraft and to the second watercraft through the separable hinge and a removable bow connector attached to the first watercraft and to the second watercraft through the separable hinge.

A dual boat apparatus comprising:

a first ship attached to a second ship through a separable hinge attachment wherein the first ship and the second ship form a single rigid navigable integral main ship when rigidly attached together through the separable hinge attachment such that the position of the second ship with respect to the first ship is immovable;

wherein the first ship and the second ship form two separate boats when the separable hinge attachment is separated into a first component and a second component such that the first component is integral with the first ship and the second component is integral with the second ship; and such that the first component and the second component are held together with a first axle through the first component and through the second component.

In another aspect, a removable transom that is connected to the first ship and to the second ship through the first axle within a first shaft in the first ship.

In another aspect, a removable bow connector that is connected to the first ship and to the second ship through the first axle within a first shaft in the first ship.

In another aspect, wherein the removable transom is connected to the first ship and to the second ship through a second axle in a second shaft within a buttress in the second ship.

In another aspect, wherein the removable bow connector is connected to the first ship and to the second ship through a second axle in a second shaft within a buttress in the second ship.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several drawings views.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in each figure.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
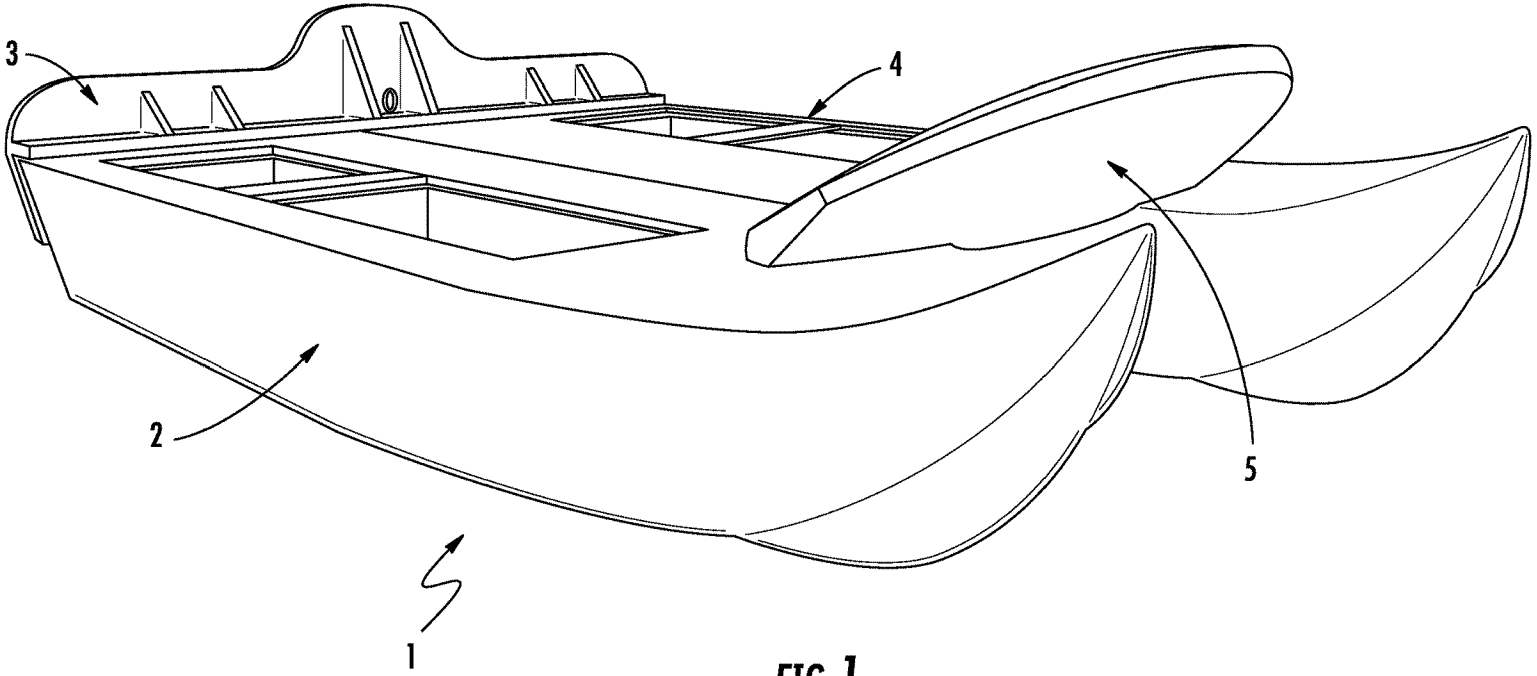
FIG. 1 presents a front view of the Dual Watercraft Separable Boat from a right front side thereof in an embodiment taught herein.

FIG. 1 presents a front view of the Dual Watercraft Separable Boat from a right front side thereof in an embodiment taught herein. The Dual Watercraft Separable Boat 1 has a first modified watercraft 2, a transom 3, a second modified watercraft 4, a bow connector 5 and various cavities therein for seats and storage space for useful items. The Dual Watercraft Separable Boat 1, as its name implies, has two modified watercrafts 2, 4 attached together to form a single boat in a first operational mode. When the two modified watercrafts 2, 4 are separated this constitutes a second operational mode thereof; here the modified watercrafts are individually maneuverable by an onboard pilot.

At this point, it should be understood that the transom 3 has a main back plate with an integral protruding lip extending out therefrom; further, there is a top portion of the main back plate above the integral protruding lip and a bottom portion (broken in two parts) of the main back plate below the integral protruding lip. This transom 3 is removable and attached across the sterns of the first 2 and second 4 modified watercrafts of the Dual Watercraft Separable Boat providing rigidity thereby. Thus, this connection between the two modified watercrafts 2, 4 enhances and maintains the integrity of the system. The transom 3 is shown with its raised center portion disposed at the centerline between the first and second modified watercrafts 2,4; additionally, various integrally formed angled buttresses provide further strength to the transom 3 as these extend from a top of an integral linear lip protruding from the front part of the transom 3, to the main back plate of the transom 3 at a front top portion of the main back plate.

Also, the integral linear lip protruding from the front part of the transom 3 is designed to sit atop the sterns of the two boats 2, 4 and thereby provides various attachment points for the sterns of the first and second modified watercrafts 2, 4.

Similarly, a removable bow connector 5 is attached between the two modified watercrafts 2, 4 somewhat behind the respective bows thereof. The two modified watercrafts 2, 4 are also connected together by respective wings 6A, 6 that extend towards each other and interconnect as described below.

Figure 2:
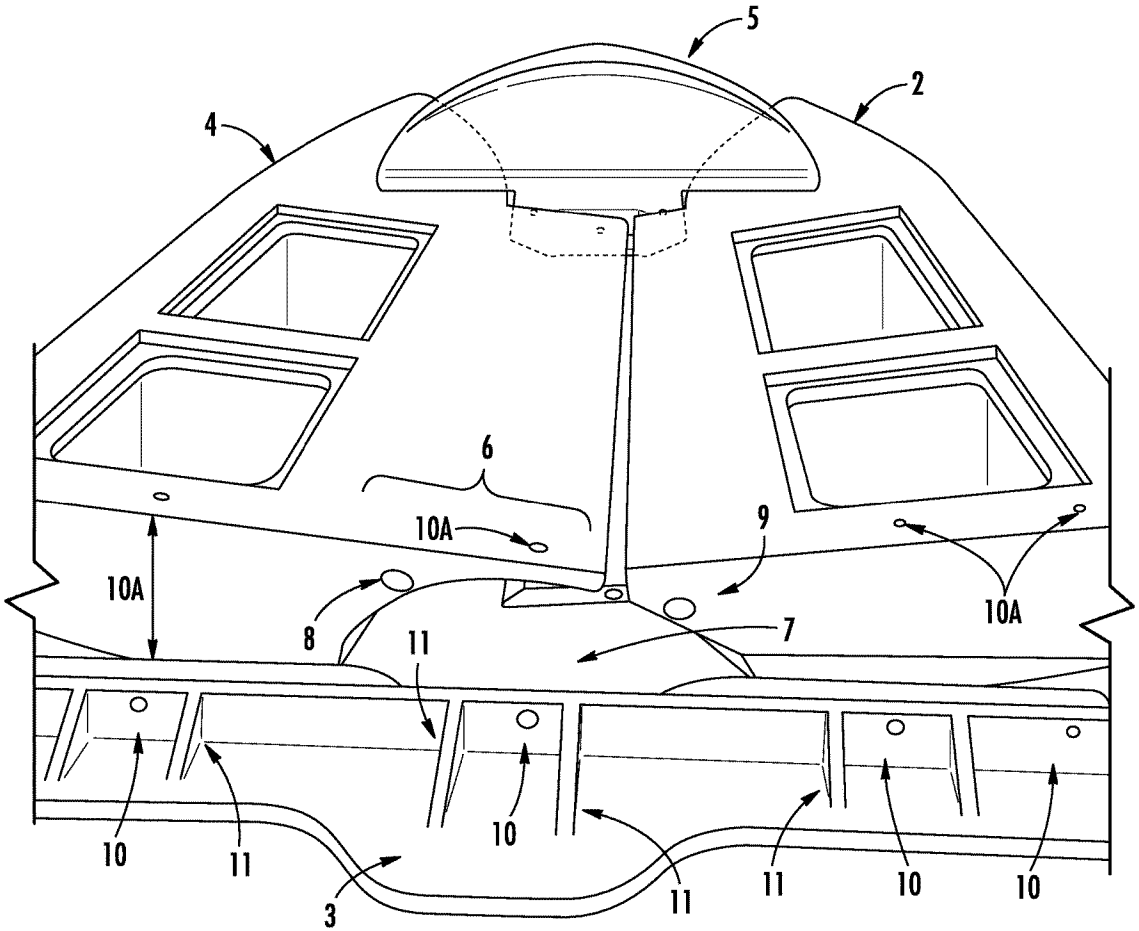
FIG. 2 presents a rear view of a Dual Watercraft Separable Boat showing the removable transom 3, wings 6, 6A and the removable bow connector in an embodiment taught herein.

FIG. 2 presents a rear view of a Dual Watercraft Separable Boat showing the removable transom 3, wings 6, 6A and the removable bow connector 5 in an embodiment taught herein. The right or first modified watercraft 2 has a port side that narrows and arches linearly at bottom up to the left in the drawing and straight laterally to the left at top; this port side ends in a wing 6A (as stated previously, straight laterally to the left at top) that is at a step down from the rest of the top surface of the modified watercraft 2 so as to permit this first wing 6A to fit under the second wing 6 of the left second modified watercraft 4.

This left or second modified watercraft 4 has a starboard side that narrows and arches at bottom up to the right and extends straight laterally to the right at the top surface thereof in the drawing; this starboard side forms a second wing 6 that is designed to form a top interconnecting surface of the modified watercraft 4 so as to permit this second wing 6 to fit atop the step down first wing 6A of the right first modified watercraft 2.

The transom 3 integral protruding lip has a top and bottom surface for use with the first 2 and second 4 modified watercrafts; the bottom surface of this linear protruding lip thereby rides atop the rear edge of the respective sterns. Various perforations 10A exist in the top surface of the sterns of both the first 2 and second 4 watercrafts and enter the storage/sitting spaces within either boat; this permits the attachment of the transom 3 using various holes 10 through the top surface (and out of the transom 3 bottom surface) thereof using bolt-nut combinations. Also, one perforation 10A exists at the first step down wing 6A near the stern thereof and a corresponding perforation 10A exists in the second wing 6 near the stern thereof; further, a corresponding hole 10 exists in the center part of the transom 3 which three holes use a bolt-nut combination for locked engagement therewith.

Thus, if the transom 3 is disposed appropriately, the perforation 10A in the first step down wing 6A and the perforation 10A in the second wing 6 are concentric and permit the insertion of a locking bolt into a corresponding hole 10 shown between two angled buttresses 11 within a transom 3 lip thereof and on into the perforations in the wings 6, 6A. A locking washer and nut complete the engagement thereto on the underside of the wing 6A.

As previously discussed, there are various holes 10 in the linear protruding lip of the transom 3 that are to be used to lock the transom 3 to the modified watercrafts 2, 4 as it rides atop the sterns of the first modified watercraft 2 and the second modified watercraft 4. When disposed appropriately perforations 10A at the sterns of the first 2 and second 4 modified watercrafts become concentric with holes 10 in the linear protruding lip of the transom. Thus, the locking bolts are first inserted in various holes 10 and on into the various perforations 10A in the sterns of the modified watercrafts 2, 4; then emerging at another side of the perforation (within the storage seating space of the boat) a locking washer and nut complete the engagement thereto on the underside thereof. This thereby effects the attachment of the transom 3 to the aforementioned sterns.

Further, there is a left longitudinal shaft 9 on the first watercraft 2 as it arches upwards from the bottom of the watercraft 2 to the top thereof. This shaft 9 extends therethrough from the rear of the first modified watercraft 2 to the forward portion thereof. A similar shift 8 extends through portions of the second modified watercraft 4 on the starboard side thereof as it arches upwards from the bottom of the watercraft towards the top thereof; these portions are curved mounts 13 that act as buttresses; these are disposed integrally underneath the wing 6 of the second modified watercraft 4. The shaft 8 is interrupted by cutouts 13A for insertion therein of connectors 12 integrally formed on the first modified watercraft 2.

Providing an attachment mechanism for the various components are axles 14. An axle 14 or similar device is inserted within the respective shafts 8, 9. Each axle has a a single integral threaded stub screw emerging from a forward end and another one emerging from a backward end thereby yielding a total of four screws for two axles (or two screws per axle). At this point, it should be understood that the transom 3 has a main back plate with an integral protruding lip extending out therefrom; thus, there is a top portion of the main back plate above the integral protruding lip and a bottom portion of the main back plate below the integral protruding lip.

Figure 3:
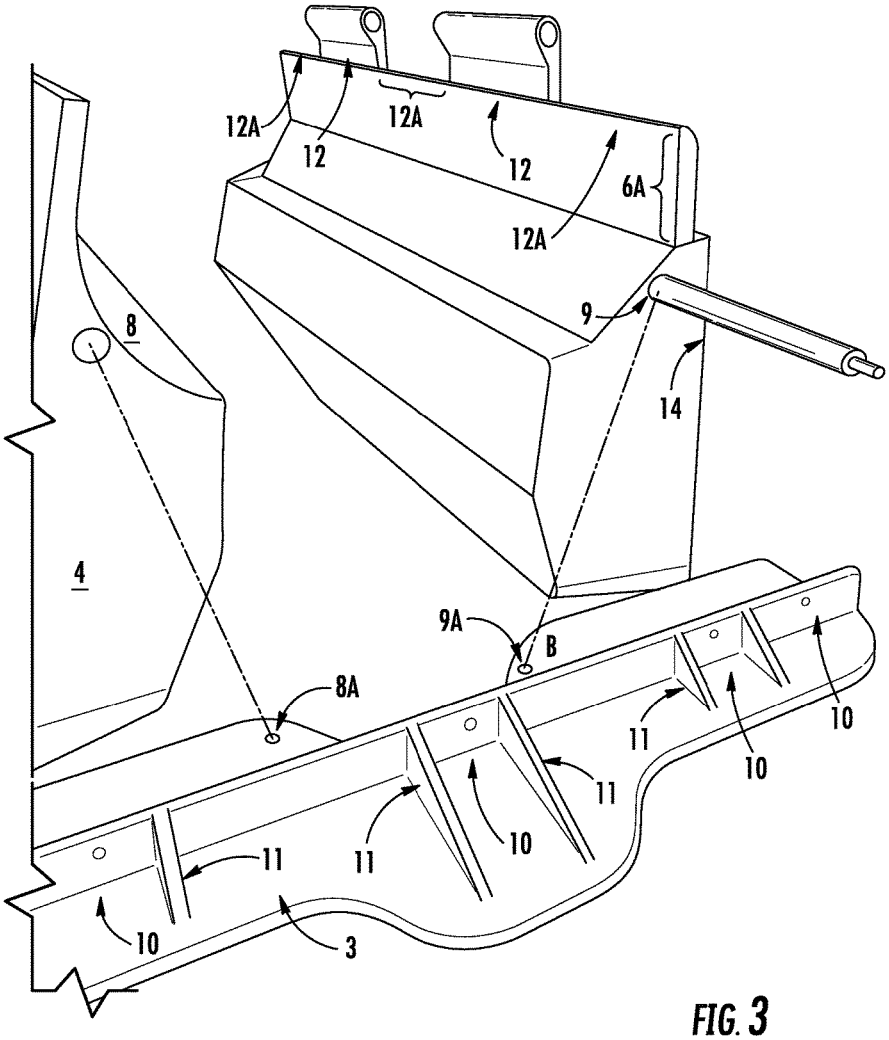
FIG. 3 presents a rear view of a Dual Watercraft Separable Boat showing the removable transom 3 as well as the first modified watercraft (right) 2 and the second modified watercraft (left) 4 shown separated from one another in an embodiment taught herein.

On the bottom portion of the main back plate there are two holes 8A, 9A disposed opposite one another. One of the stub screws is inserted within only one corresponding hole 8A, 9A (as shown in FIG. 3) under the protruding linear lip of the transom 3 and the other within a similar hole (5E1 to 5E) in the bow connector 5. Further, the stub screw passes therethrough and emerges on an external surface of the transom 3 or bow connector 5 where it is attached thereto using similar modalities such as washer nut combination.

FIG. 3 presents a rear view of a Dual Watercraft Separable Boat showing the removable transom 3 as well as the first modified watercraft (right) 2 and the second modified watercraft (left) 4 shown separated from one another; these are also shown rotated on their respective external lateral sides so that the wings 6A, 6 are shown ascending upwards in the drawing. The first modified watercraft 2 has connectors for attaching it to the second modified watercraft 4. The figure clearly shows the connectors 12 extending out from and parallel to wing 6A. Each connector 12 ends in a rounded surface having a corresponding rounded cavity therein perforating the connector from its forward portion to its rear portion.

Figure 4:
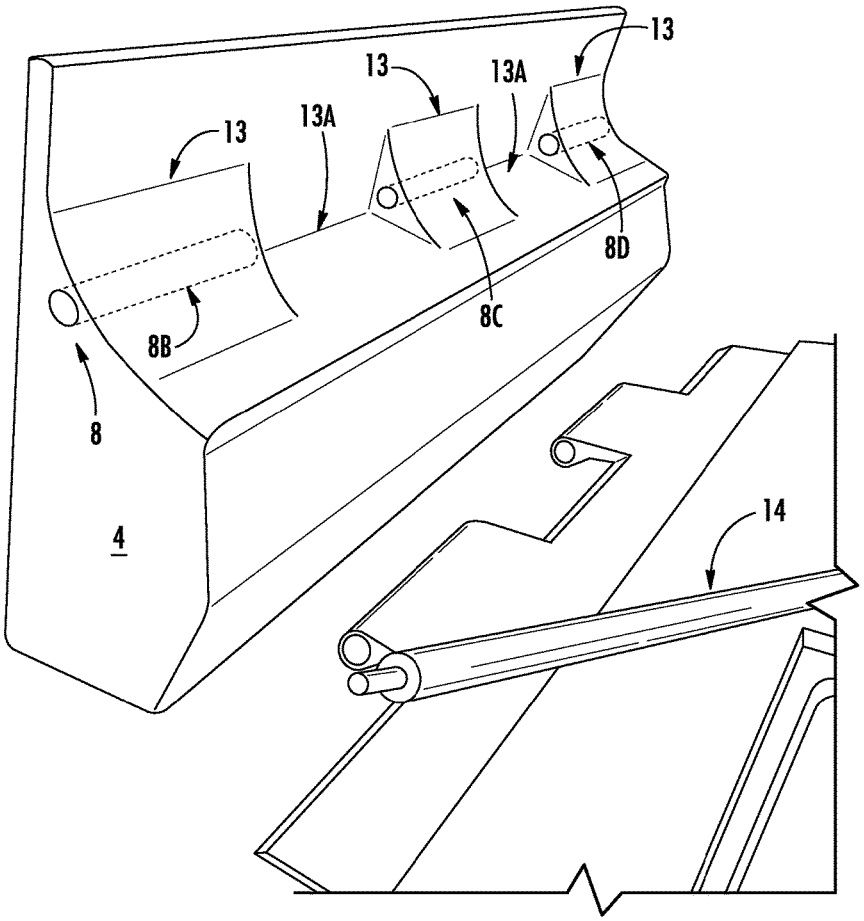
FIG. 4 presents a rear perspective view of a Dual Watercraft Separable Boat showing a portion of the first modified watercraft (right) 2 and the second modified watercraft (left) 4 shown separated from one another in an embodiment taught herein.

There is a space 12A between each connector 12 so that it matches a corresponding mount 13 on the second modified watercraft shown 4 with respect to FIG. 4. Similarly, each connector 12 matches a corresponding space 13A on the second modified watercraft 4 underneath wing 6 shown with respect to FIG. 4. Thus, when the first 2 and second modified watercrafts 4 are rotated so that both watercrafts appear as normal with the bottom thereof on the water or ground, they are brought together and as a result the space 12A is filled by mount 13 and the space 13A is filled by the connector 12. The axle 14 passing through shaft 8 is inserted within mounts 13 and connectors 12 for added strengthening of the connection there between.

On the bottom portion of the main back plate there are two holes 8A, 9A disposed opposite one another. One of the stub screws is inserted within only one corresponding hole 8A, 9A under the protruding linear lip of the transom 3 and the other within a similar hole (5E1 to 5E) in the bow connector 5. Further, the stub screw passes therethrough and emerges on an external surface of the transom 3 or bow connector 5 where it is attached thereto using similar modalities such as washer nut combination.

FIG. 4 presents a rear perspective view of a Dual Watercraft Separable Boat showing a portion of the first modified watercraft (right) 2 and the second modified watercraft (left) 4 shown separated from one another in an embodiment taught herein. The second modified watercraft (left) 4 is also shown rotated on its external lateral side so that the wing 6 is shown ascending upwards in the drawing. The shaft 8 is punctuated by three mounts 13 formed at the bottom of the wing 6 and two cutouts 13A as described below. Each mount 13 has a portion of the shaft 8 therein as the shaft is broken in several portions as was previously described. Thus, the shaft 8 has a first portion 8B in the first mount 13, a second portion 8C in the second mount 13 and a third portion 8D in the third mount 13.

The shaft 8 has two cutouts 13A that are shown between a first mount 13 and a second mount 13 as well as between the second mount 13 and the third mount 13. These cutouts' space are substituted by the connectors 12 so that the aluminum axle 14 can enter and exit each mount 13 then each connector 12 and so forth until it emerges at either the bow or stern of the second modified watercraft 3. Then a first integral screw at a first end of the aluminum axle 14 is inserted within a bow connector 5 hole (5E1 exiting at 5E of bow connector 5) or the second integral screw is inserted within transom 3 hole 8A (FIG. 3) for attachment of washer-nut combinations thereby locking the four main components together. It should be apparent that as you have two aluminum axles 14 having an integral screw at a front end and also at its back end, that the process is repeated for the other boat 2 having a complete shaft 9 within the inner lateral body of this boat 2. Thus, this second 9 has an axle 14 inserted therein and attached to the transom at 9A in FIG. 3 and at the bow connector at an appropriate side 5E1 existing at 5E using washer nut combinations.

Figure 5A:
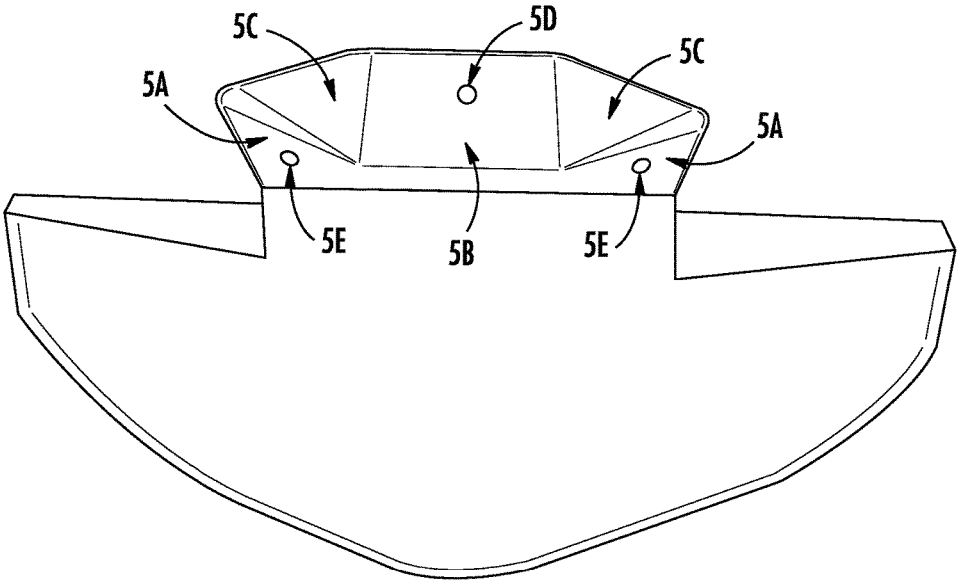
FIG. 5A presents a front upside down view of the bow connector in an embodiment taught herein.

FIG. 5A presents a front upside down view of the bow connector in an embodiment taught herein. Here an integral connection portion of the bow connector 5 extends beyond its main body. This connection portion has two holes 5E (used for axles 14) disposed opposite one another centrally located on two different integral triangular shaped portions 5A of the connection portion that are separated by an integral narrow rectangular strip of the connection portion. A first edge of the first triangular shaped portion 5A separates it from a first triangular shaped surface 5C integrally formed therewith; and a second edge of a second triangular shaped portion 5A separates the second triangular shaped portion 5A from a second triangular shaped surface 5C integrally formed therewith. Finally, these two triangular shaped surfaces 5C each have a different edge bounding a central rectangular surface 5B having a centrally disposed hole 5D for use with transom hole 6B using nut washer bolt combination.

Figure 5B:
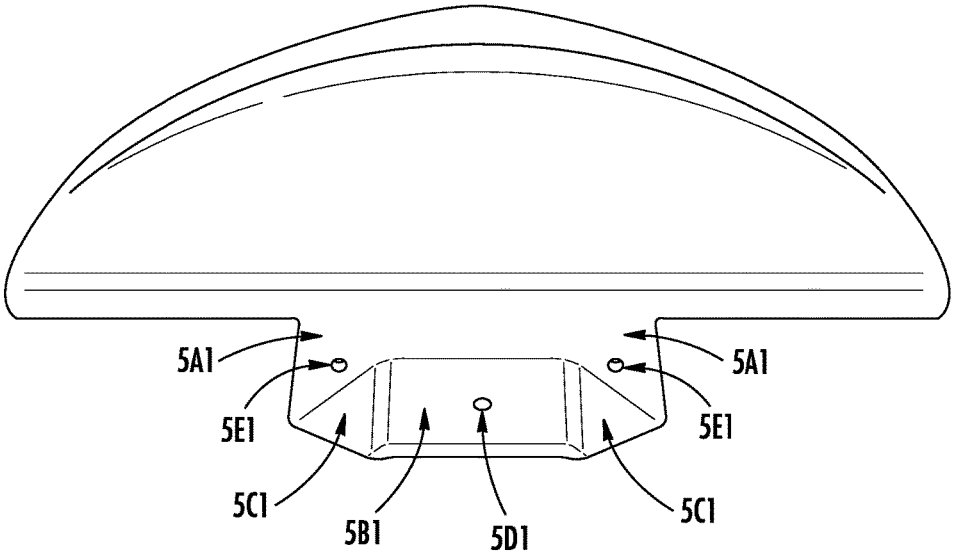
FIG. 5B presents a rear view of the bow connector in an embodiment taught herein.

FIG. 5B presents a rear view of the bow connector in an embodiment taught herein. Here an integral back connection portion of the bow connector 5 extends beyond its main body. This back connection portion has two holes 5E1 (opposite side of hole 5E in FIG. 5A) disposed opposite one another centrally located on two different integral triangular shaped portions 5A1 of the back connection portion that are separated by an integral narrow rectangular strip of the back connection portion. A first edge of the first triangular shaped portions 5A1 separates it from a first triangular shaped surface 5C1 integrally formed therewith; and a second edge of a second triangular shaped portion 5A1 separates the second triangular shaped portion 5A1 from a second triangular shaped surface 5C1 integrally formed therewith. Finally, these two triangular shaped surfaces 5C1 each have a different edge bounding a central rectangular surface 5B1 having a centrally disposed hole 5D1 (same as 5D on front) for use with transom hole 6B using nut washer bolt combination.

Figure 6:
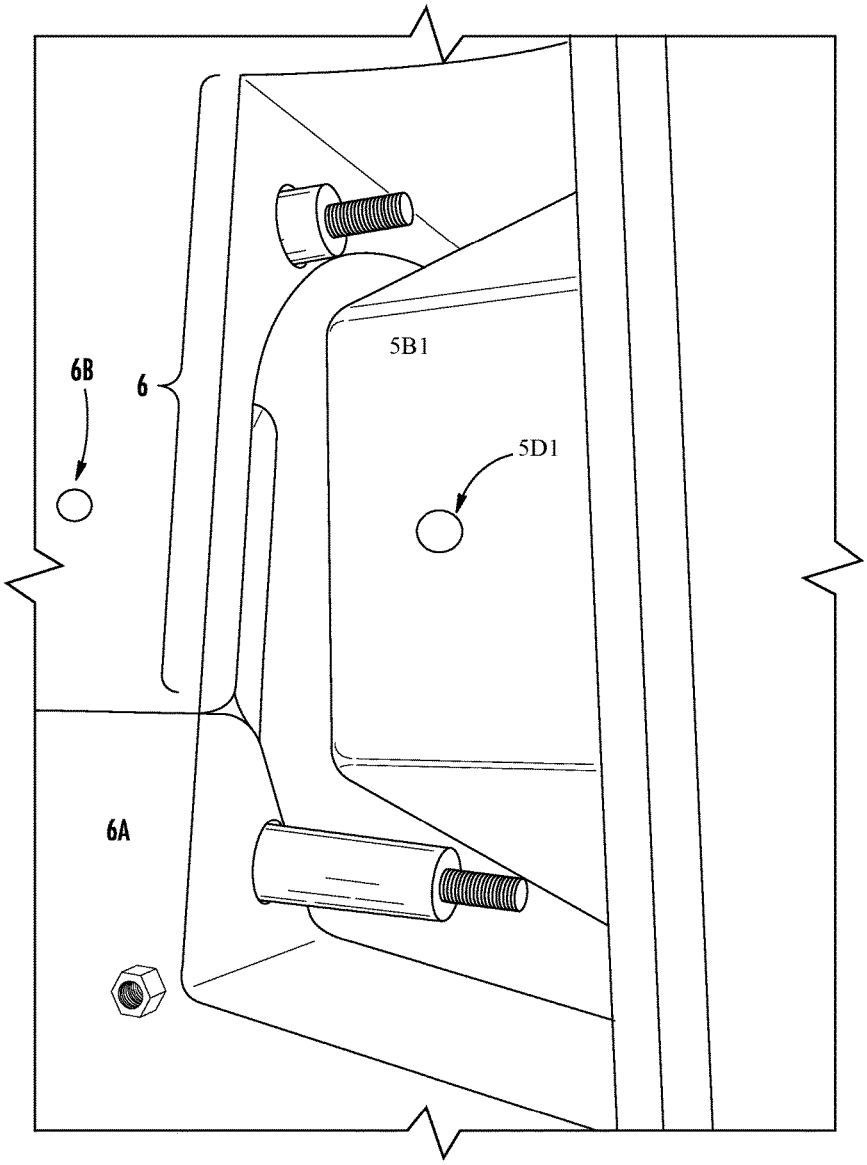
FIG. 6 presents a closeup view of how the bow connector attaches to a bow portion of the first modified watercraft and the second modified watercraft in an embodiment taught herein.

FIG. 6 presents a closeup view of how the bow connector 5 attaches to the bow portion of the first modified watercraft 2 and the second modified watercraft 4 in an embodiment taught herein. The central rectangular surface 5B1 has a centrally disposed hole 5D1 that exits out the same hole relabeled 5D on the other side of the connector 5. This centrally disposed hole 5D1 is associated with two concentrically located holes 6B located one to each wing 6, 6A of the left and right boats respectively that are held together by washer, nut, bolt combination.

It should be appreciated from this discussion that attachments made between various perforations or holes are effected using bolt washer nut combinations even though the aforementioned bolt washer nut combinations in the foregoing are not specifically described as doing so. Further, to attach the axles 14 to the bow connector 5 or transom 3, require appropriate use of washer nut combinations in association with the integral screws of the axles. Thus, it should be understood that one of the stub screws of axle 14 is inserted within only one corresponding hole within (5E1 to 5E) in the bow connector 5. Further, the stub screw passes therethrough and emerges on an external surface of the bow connector 5 where it is attached thereto using similar modalities such as washer nut combination. The other axle is similarly attached from the other shaft using the other corresponding hole (5E1 to 5E) of the bow connector. Finally, a Tent or Composite house/structure is optionally mounted on the Deck.

Further, the above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A separable boat system comprising:

a first boat removably attached to a second boat;

wherein the first boat and the second boat are removably attached side by side through a separable hinge instead of front to back or back to front of a first boat to a second boat;

such that the separable hinge is held together using a first axle within a first shaft in a body of the first boat;

wherein the first boat and second boat have a unified first floatation operational mode such that the position of the second boat with respect to the first boat is immovable when attached together; and a dual boat second floatation operational mode when separated from each other.

2. The separable boat system of claim 1, further comprising:

a removable transom attached to the first and the second boat using the first axle within a first shaft in the body of the first boat.

3. The separable boat system of claim 1, further comprising:

a removable bow connector attached to the first and the second boat using the first axle within a first shaft in the body of the first boat.

4. The separable boat system of claim 2, further comprising: the removable transom attached to the first and the second boat using a second axle within a second shaft in the body of the second boat.

5. The separable boat system of claim 1, further comprising:

a first wing extending from the first boat to the second boat.

6. The separable boat system of claim 5, further comprising:

a second wing extending from the second boat to the first boat.

7. The separable boat system of claim 6, wherein the first wing sits underneath the second wing.

8. The separable boat system of claim 3, further comprising:

the removable bow connector attached to the first and the second boat using a second axle within a second shaft in the body of the second boat.

9. The separable boat system of claim 5, wherein the first wing further comprises:

a knuckle.

10. The separable boat system of claim 1, further comprising:

a knuckle integral with a first integral wing of the first boat;

a buttress integral with a second integral wing of the second boat; wherein the separable hinge comprises a knuckle and buttress attached together through an axle.

11. The separable boat system of claim 6, wherein the second boat further comprises:

a buttress.

12. The separable boat system of claim 1, wherein the second boat further comprises:

a buttress integral with and underneath a wing integral with the second boat.

13. A separable boat comprising:

a first boat removably attached to a second boat having a first wing extending from the first boat to the second boat;

a second wing extending from the second boat to the first boat;

a knuckle integral with a first wing of the first boat;

a buttress integral with and underneath a second wing integral with the second boat; wherein the knuckle and the buttress are attached together using an axle therethrough that also attaches to a transom and to a bow connector.

14. A dual ship apparatus comprising:

a first ship attached to a second ship through a separable hinge attachment wherein the first ship and the second ship form a single rigid navigable integral main ship when rigidly attached together through the separable hinge attachment such that the position of the second ship with respect to the first ship is immovable;

wherein the first ship and the second ship form two separate ships when the separable hinge attachment is separated into a first component and a second component such that the first component is integral with the first ship and the second component is integral with the second ship; and such that the first component and the second component are held together with a first axle through the first component and through the second component.

15. The dual ship apparatus of claim 14, further comprising: a removable transom that is connected to the first ship and to the second ship through the first axle within a first shaft in the first ship.

16. The dual ship apparatus of claim 14, further comprising: a removable bow connector that is connected to the first ship and to the second ship through the first axle within a first shaft in the first ship.

17. The dual ship apparatus of claim 15, further comprising: wherein the removable transom is connected to the first ship and to the second ship through a second axle in a second shaft within a buttress in the second ship.

18. The dual ship apparatus of claim 16, further comprising: wherein the removable bow connector is connected to the first ship and to the second ship through a second axle in a second shaft within a buttress in the second ship.

19. A divisible boating system comprising:

a first watercraft connected through a separable hinge to a second watercraft;

a first wing integral with the first watercraft extending from the first watercraft to the second watercraft wherein the first wing has an integral knuckle;

a second wing integral with the second watercraft extending from the second watercraft to the first watercraft;

a buttress integral with the second watercraft; wherein the separable hinge is a knuckle and the buttress attached together using an axle therethrough.

20. The divisible boating system of claim 19, further comprising:

a removable transom attached to the first watercraft and to the second watercraft through the separable hinge and a removable bow connector attached to the first watercraft and to the second watercraft through the separable hinge.

* * * * *